US006484893B1

(12) United States Patent
Tkatch

(10) Patent No.: US 6,484,893 B1
(45) Date of Patent: Nov. 26, 2002

(54) SHELVING APPARATUS

(76) Inventor: Vladimir D. Tkatch, 325 Macedonia Crescent, Mississauga, Ontario (CA), L5B 3J7

( * ) Notice: Subject to any disclaimer, the term of this patent is extended or adjusted under 35 U.S.C. 154(b) by 0 days.

(21) Appl. No.: 09/895,030

(22) Filed: Jun. 29, 2001

(51) Int. Cl.[7] ..... A47F 5/00

(52) U.S. Cl. ..... 211/94.02; 211/94.01; 211/103; 211/162; 312/132; 312/334.23

(58) Field of Search ..... 108/143; 211/90.01, 211/90.02, 90.03, 94.01, 94.02, 103, 117, 162; 312/131, 132, 334.23, 334.26

(56) References Cited

U.S. PATENT DOCUMENTS 637,361 A * 11/1899 Suters
1,750,291 A * 3/1930 Whetstone
2,382,354 A * 8/1945 Wales
3,874,756 A * 4/1975 Greene
4,854,656 A * 8/1989 O'Keefe
5,057,977 A * 10/1991 Kurzman ..... 312/131 X
5,086,936 A 2/1992 Remmers
5,127,721 A 7/1992 Inden
5,209,555 A 5/1993 Camilleri
D358,727 S 5/1995 Dickinson et al.
5,586,816 A 12/1996 Geiss
5,779,067 A * 7/1998 Reaney ..... 211/90.04
5,810,179 A 9/1998 Kleiman
6,098,815 A * 8/2000 Nesser ..... 211/162 X
6,336,692 B1 * 1/2002 Snyder

* cited by examiner

*Primary Examiner*—Robert W. Gibson, Jr.

(57) ABSTRACT

A shelving apparatus for providing shelving which is retractable and easily reachable. The shelving apparatus includes a housing has a back wall, a first lateral side wall, a second lateral side wall, a bottom wall and a top wall. A front side of the housing has an opening therein defined by a front edge of the top, bottom and lateral side walls. At least one railing is positioned in the housing and is attached to the top wall. The railing extends from the back wall to the front edge of the top wall. A shelving assembly is extendably positioned on the railing such that the shelving assembly may be selectively positioned between a point inside of the housing and a point outside of the housing.

12 Claims, 4 Drawing Sheets

SHELVING APPARATUS

BACKGROUND OF THE INVENTION

1. Field of the Invention

The present invention relates to shelf devices and more particularly pertains to a new shelving apparatus for providing shelving which is retractable and easily reachable.

2. Description of the Prior Art

The use of shelf devices is known in the prior art. More specifically, shelf devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,127,721; U.S. Pat. No. 5,086,936; U.S. Pat. No. 5,586,816; U.S. Pat. No. 5,810,179; U.S. Pat. No. 5,209,555; and U.S. Des. Pat. No. 358,727.

While these devices fulfill their respective, particular objectives and requirements, the aforementioned patents do not disclose a new shelving apparatus. The inventive device includes a housing has a back wall, a first lateral side wall, a second lateral side wall, a bottom wall and a top wall. A front side of the housing has an opening therein defined by a front edge of the top, bottom and lateral side walls. At least one railing is positioned in the housing and is attached to the top wall. The railing extends from the back wall to the front edge of the top wall. A shelving assembly is extendably positioned on the railing such that the shelving assembly may be selectively positioned between a point inside of the housing and a point outside of the housing.

In these respects, the shelving apparatus according to the present invention substantially departs from the conventional concepts and designs of the prior art, and in so doing provides an apparatus primarily developed for the purpose of providing shelving which is retractable and easily reachable.

SUMMARY OF THE INVENTION

In view of the foregoing disadvantages inherent in the known types of shelf devices now present in the prior art, the present invention provides a new shelving apparatus construction wherein the same can be utilized for providing shelving which is retractable and easily reachable.

The general purpose of the present invention, which will be described subsequently in greater detail, is to provide a new shelving apparatus apparatus and method which has many of the advantages of the shelf devices mentioned heretofore and many novel features that result in a new shelving apparatus which is not anticipated, rendered obvious, suggested, or even implied by any of the prior art shelf devices, either alone or in any combination thereof.

To attain this, the present invention generally comprises a housing has a back wall, a first lateral side wall, a second lateral side wall, a bottom wall and a top wall. A front side of the housing has an opening therein defined by a front edge of the top, bottom and lateral side walls. At least one railing is positioned in the housing and is attached to the top wall. The railing extends from the back wall to the front edge of the top wall. A shelving assembly is extendably positioned on the railing such that the shelving assembly may be selectively positioned between a point inside of the housing and a point outside of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shelving apparatus apparatus and method which has many of the advantages of the shelf devices mentioned heretofore and many novel features that result in a new shelving apparatus which is not anticipated, rendered obvious, suggested, or even implied by any of the prior art shelf devices, either alone or in any combination thereof.

It is another object of the present invention to provide a new shelving apparatus which may be easily and efficiently manufactured and marketed.

It is a further object of the present invention to provide a new shelving apparatus which is of a durable and reliable construction.

An even further object of the present invention is to provide a new shelving apparatus which is susceptible of a low cost of manufacture with regard to both materials and labor, and which accordingly is then susceptible of low prices of sale to the consuming public, thereby making such shelving apparatus economically available to the buying public.

Still yet another object of the present invention is to provide a new shelving apparatus which provides in the apparatuses and methods of the prior art some of the advantages thereof, while simultaneously overcoming some of the disadvantages normally associated therewith.

Still another object of the present invention is to provide a new shelving apparatus for providing shelving which is retractable and easily reachable.

Yet another object of the present invention is to provide a new shelving apparatus which includes a housing has a back wall, a first lateral side wall, a second lateral side wall, a bottom wall and a top wall. A front side of the housing has an opening therein defined by a front edge of the top, bottom and lateral side walls. At least one railing is positioned in the housing and is attached to the top wall. The railing extends from the back wall to the front edge of the top wall. A shelving assembly is extendably positioned on the railing such that the shelving assembly may be selectively positioned between a point inside of the housing and a point outside of the housing.

Still yet another object of the present invention is to provide a new shelving apparatus that has shelving which is movable outside of the cabinet housing and extends downward for reaching the top shelves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
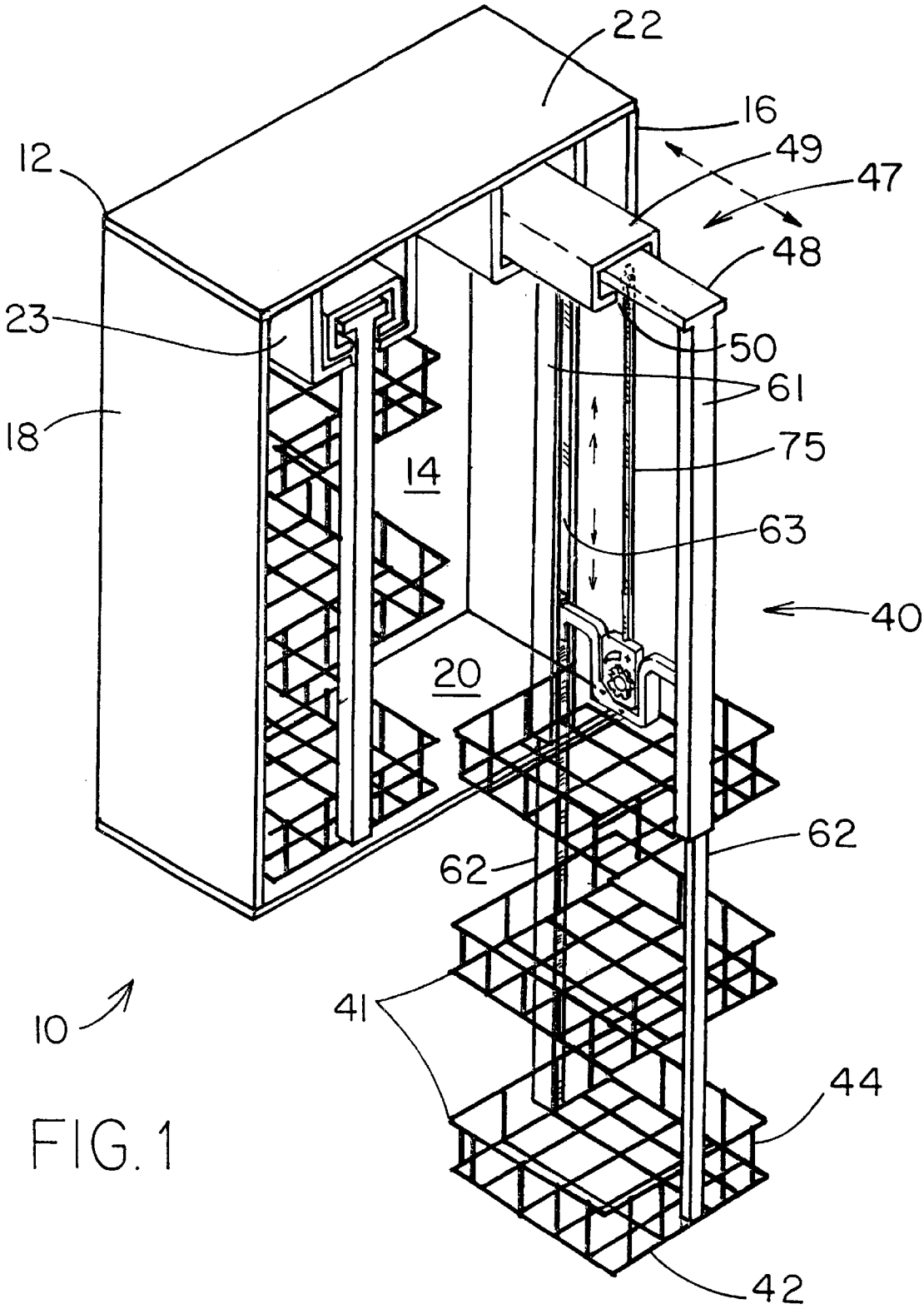
FIG. 1 is a schematic perspective view of a new shelving apparatus according to the present invention.
Figure 2:
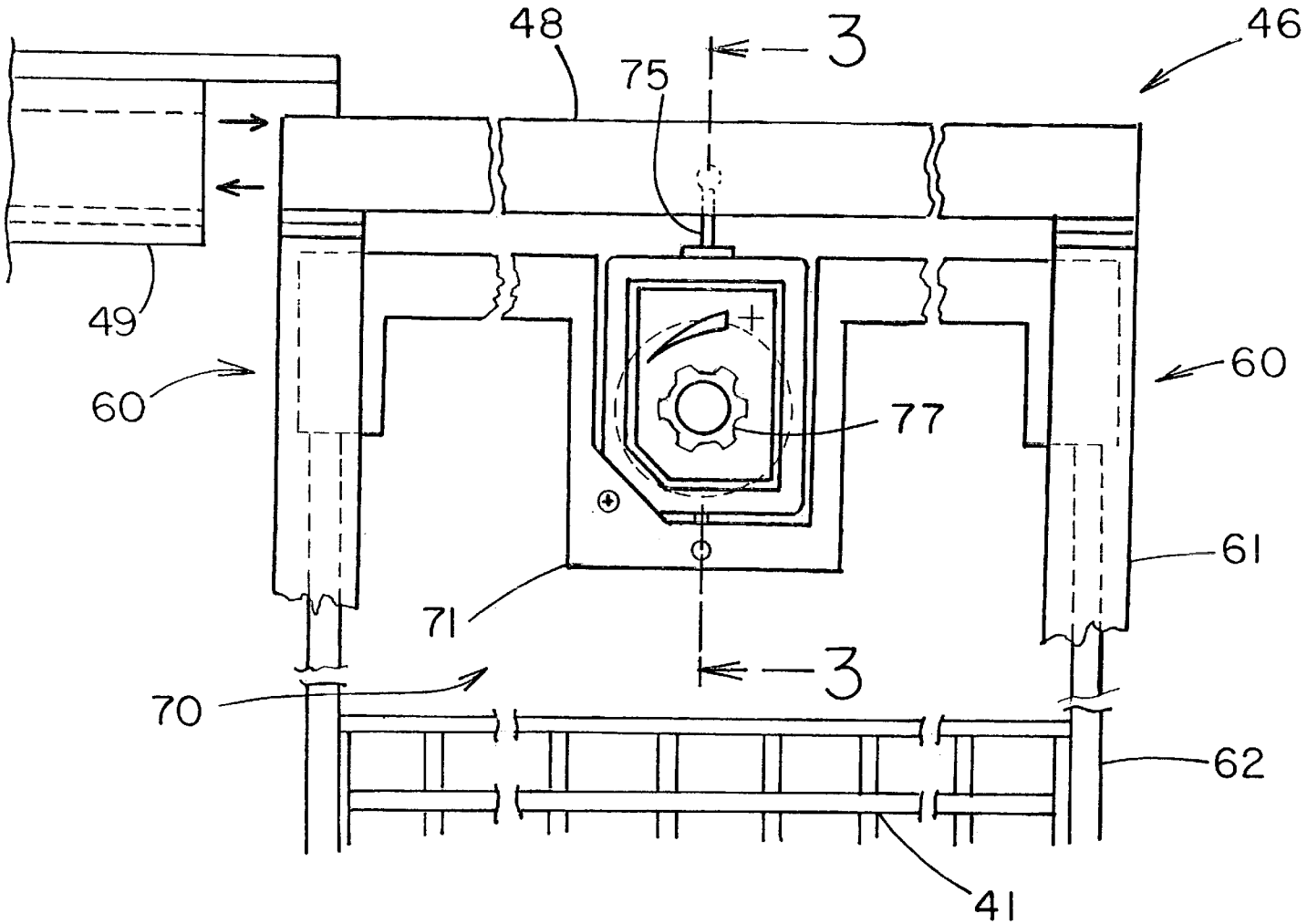
FIG. 2 is a schematic side view of the present invention.
Figure 3:
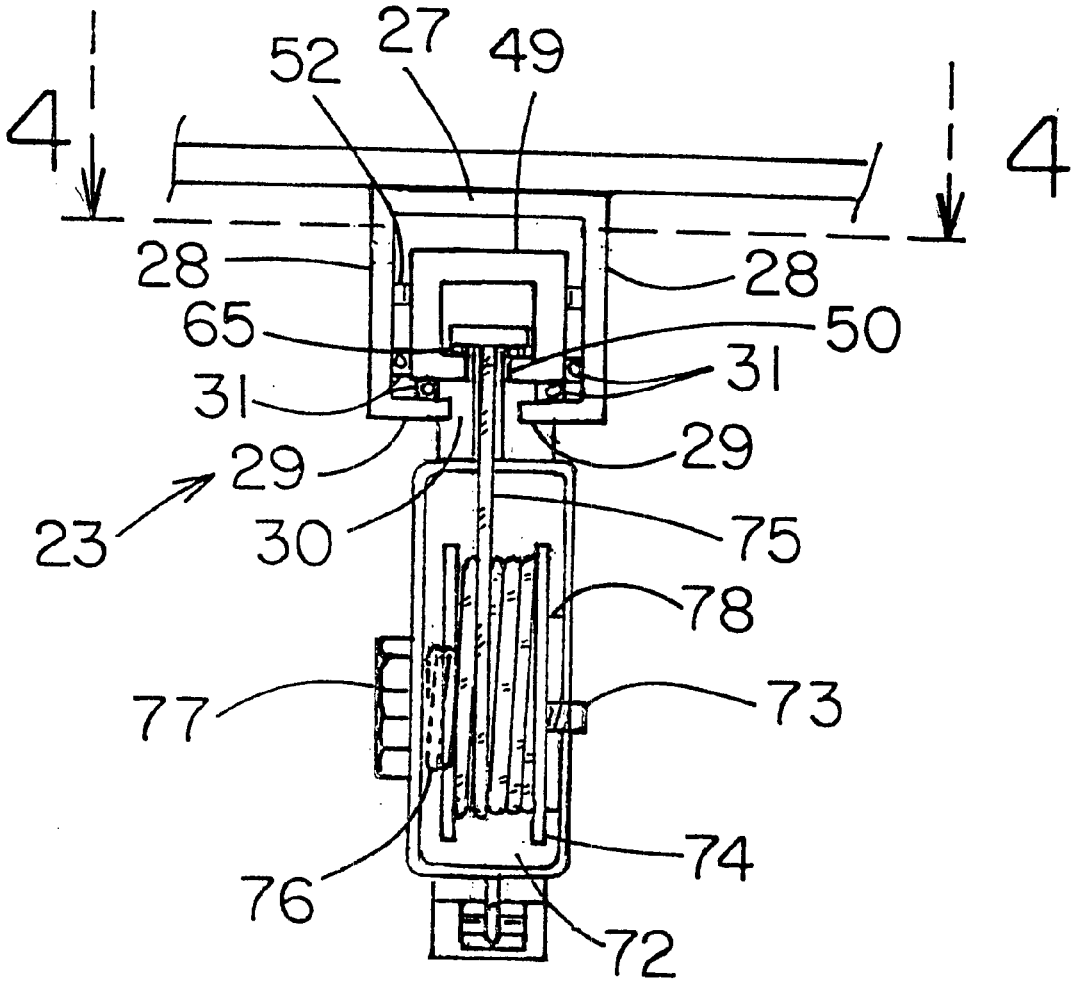
FIG. 3 is a schematic cross-sectional view taken along line 3—3 of the present invention.
Figure 4:
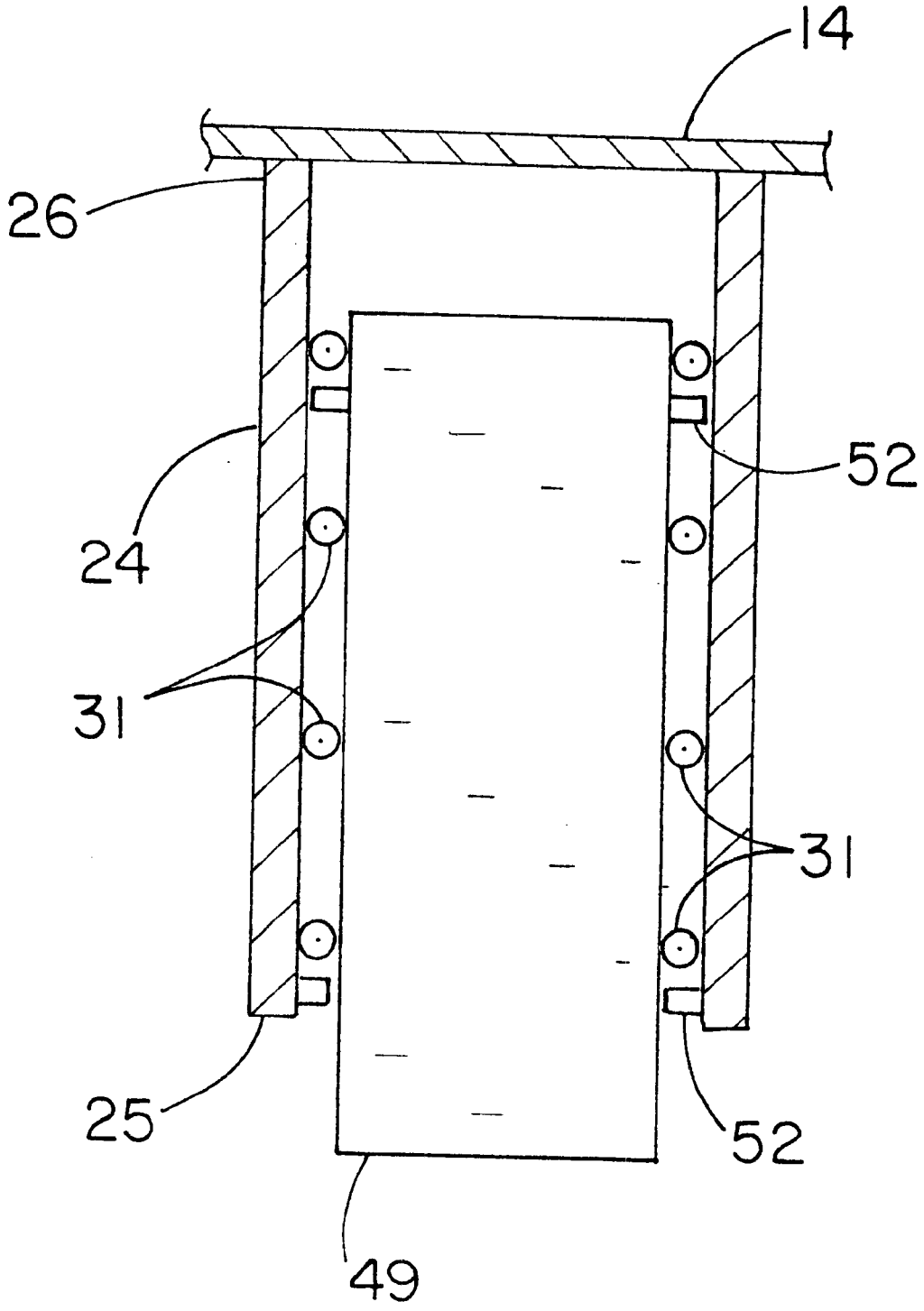
FIG. 4 is a schematic cross-sectional view taken along line 4—4 of the present invention.

With reference now to the drawings, and in particular to FIGS. 1 through 4 thereof, a new shelving apparatus embodying the principles and concepts of the present invention and generally designated by the reference numeral 10 will be described.

As best illustrated in FIGS. 1 through 4, the shelving apparatus 10 generally comprises a housing 12 having a back wall 14, a first lateral side wall 16, a second lateral side wall 18, a bottom wall 20 and a top wall 22. A front side of the housing 12 has an opening therein defined by a front edge of the top 22, bottom 20 and lateral side walls 16, 18.

Each of a pair of railings 23 each is positioned in the housing 12 and is attached to the top wall 22. Each of the railings 23 extends from the back wall 14 to the front edge of the top wall 22. The railings 23 are spaced from each other. Each of the railings includes an elongated member 24 having a first end 25 and a second end 26. The elongated member 24 has a middle portion 27 and a pair of legs 28 such that a cross-section taken traverse to a longitudinal axis of the elongated member generally has an upside down U-shape. Each of the legs 28 has a free end having a flange 29 thereon. The flanges 29 extend toward each other such that a slot 30 is defined between the flanges 29. Each of the flanges 29 has a plurality of wheels 31 rotatably attached thereto having a rotational axis orientated perpendicular to the longitudinal axis of the elongated member 24. Each of the legs 28 has a plurality wheels 31 rotatably coupled thereto having a rotational axis orientated perpendicular to the longitudinal axis of the elongate member 24.

Each of a pair of shelving assemblies 40 is extendably positioned on one of the railings 23 such that each of the shelving assemblies 40 may be selectively positioned between a point inside of the housing 12 and a point outside of the housing 12. Each of the shelving assemblies 40 includes a plurality of baskets 41. Each of the baskets 41 has a bottom wall 42 and a peripheral wall 44 extending upwardly from the bottom wall. The baskets 41 define shelves and may instead each comprise a panel. The baskets may have alternative shapes and compartments for items such as boxes, cans, plates or cups. The sizes may also be varied for different holding capacities.

A hanging assembly 46 comprises a top portion 47 and pair of supports 60 extending down from the top portion 47. The supports 60 are spaced from each other. Each of the baskets 41 is positioned between and is attached to each of the supports 60 such that the baskets 41 are vertically positioned with relation to each other as shown in FIG. 1.

The top portion 47 is extendably positioned on one of the railings 23. The top portion 47 includes a bar 48 and a sleeve 49. The sleeve 49 is positionable in the elongated member 24 and is movable along the wheels 31. Ideally, stops 52 are positioned in the railing 23 and on the sleeve 49 to prevent the sleeve from exiting the railing 23. The bar 48 is extendable in the sleeve 49. The sleeve 49 has a pair of open ends and a bottom side having a channel 50 therein extending between ends of the sleeve 49. The supports 60 are attached to the bar 48 and extend through the channel 50. The bar 48 preferably rides upon bearings 65 positioned in the sleeves 49. The bar may have stops 52 thereon as well as the inside of the sleeve 49 for preventing the bar from being removed from the sleeve 49.

Each of the supports 60 includes a first portion 61 and a second portion 62. Each of the first portions 61 is attached to the bar 48 and each defines a guide. Each of the first portions 61 have elongated depressions 63 therein extending between and through opposite ends of the first portions 61. The depressions 63 face each other. Each of the second portions 62 is positioned in the depressions 63 and is extendable between an extended position and a retracted position. The baskets 41 are attached to the second portions 62 of the supports 60.

A lifting means 70 lifts the second portion 62 toward the bar 48 and into the retracted position. The lifting means 70 includes a casing 71 having a chamber 72 therein. The casing 71 is attached to each of the second portions 62. An axle 73 extends through the casing and through the chamber. The axle 73 is threaded and is threadably coupled to the casing 71. A spool 74 is positioned in the casing. The axle 73 extends through the spool 74 such that the spool 74 is rotatable with respect to the axle. A cord 75 is attached to and is wound about the spool 74 when the second portion 62 is in the retracted position. The cord 75 has an end attached to the bar 48. A biasing means 76 biases rotation of the spool 74 in a first direction. The biasing means 76 comprises a spring positioned between and attached to the spool 74 and the casing 71. The spring 76, or biasing means, is wound about the axle 73. The axle 73 has an end having a handle 77 thereon and positioned outside of the casing 71. The axle 73 has a panel 78 attached thereto and positioned in the chamber 72. The panel 78 may be abutted against the spool 74 for selectively preventing rotation of the spool 74. Also envisioned is a lifting means 70 which is motorized for lowering and lifting the baskets 41. Also, a plurality of lifting means 70 may be used between the shelves for varying the space between each of the shelves.

In use, back wall 14 of the housing 12 is attached to a vertical wall of a dwelling. The baskets 41 are removable from the housing 12 and the supports 60 are lowered such that a user may reach all of the baskets 41. This allows a person to effectively reach upper areas of a cabinet which are often not used. The lifting means 70 helps support the weight of baskets and any contents therein, and rewinds the cord 75 on the spool 74. The handle 77 is used to place pressure on the spool 74 with the panel 78 to prevent the spool 74 from unwinding too easily and supporting more weight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable shelving device comprising:

a housing having a back wall, a first lateral side wall, a second lateral side wall, a bottom wall and a top wall, a front side of said housing having an opening therein defined by a front edge of said top, bottom and lateral side walls;

at least one railing being positioned in said housing and being attached to said top wall, said railing extending from said back wall to said front edge of said top wall;

a shelving assembly being extendably positioned on said railing such that said shelving assembly may be selectively positioned between a point inside of said housing and a point outside of said housing; and wherein said railing includes an elongated member having a first end and a second end, said elongated member having a middle portion and a pair of legs such that a cross-section taken traverse to a longitudinal axis of said elongated member generally has an upside down U-shape, each of said legs having a free end having a flange thereon, said flanges extending toward each other such that a slot is defined between said flanges, each of said flanges having a plurality of wheels rotatably attached thereto and having a rotational axis orientated perpendicular to said longitudinal axis of said elongated member.

2. A retractable shelving device comprising:

a housing having a back wall, a first lateral side wall, a second lateral side wall, a bottom wall and a top wall, a front side of said housing having an opening therein defined by a front edge of said top, bottom and lateral side walls;

at least one railing being positioned in said housing and being attached to said top wall, said railing extending from said back wall to said front edge of said top wall;

a shelving assembly being extendably positioned on said railing such that said shelving assembly may be selectively positioned between a point inside of said housing and a point outside of said housing; and wherein said shelving assembly includes a plurality of baskets, each of said baskets having a bottom wall and a peripheral wall extending upwardly from said bottom wall; and a hanging assembly comprising a top portion and pair of supports extending down from said top portion, said supports being spaced from each other, each of said baskets being positioned between and being attached to each of said supports such that said baskets are vertically positioned with relation to each other, said top portion being extendably positioned on said railings.

3. The retractable shelving device as in claim 1, wherein said shelving assembly includes:

a plurality of baskets, each of said baskets having a bottom wall and a peripheral wall extending upwardly from said bottom wall;

a hanging assembly comprising a top portion and pair of supports extending down from said top portion, said supports being spaced from each other, each of said baskets being positioned between and being attached to each of said supports such that said baskets are vertically positioned with relation to each other, said top portion being extendably positioned on said railings.

4. The retractable shelving device as in claim 3, wherein said top portion includes a bar and a sleeve, said sleeve being positionable in said elongated member and being movable along said wheels, said bar being extendable in said sleeve, said sleeve has a pair of open ends and a bottom side having a channel therein extending between ends of said sleeve, said supports being attached to said bar and extending through said channel.

5. The retractable shelving device as in claim 4, wherein each of said supports includes a first portion and a second portion, each of said first portions being attached to said bar and defining walls, each of said first portions having elongated depressions therein extending between and through opposite ends of said first portions, said depressions facing each other, each of said second portions being positioned in said depressions and being extendable between an extended position and a retracted position, said baskets being attached to said second portions of said supports.

6. The retractable shelving device as in claim 2, wherein said top portion includes a bar and a sleeve, said sleeve being positionable in said elongated member and being movable along said wheels, said bar being extendable in said sleeve, said sleeve has a pair of open ends and a bottom side having a channel therein extending between ends of said sleeve, said supports being attached to said bar and extending through said channel.

7. The retractable shelving device as in claim 6, wherein each of said supports includes a first portion and a second portion, each of said first portions being attached to said bar and defining walls, each of said first portions having elongated depressions therein extending between and through opposite ends of said first portions, said depressions facing each other, each of said second portions being positioned in said depressions and being extendable between an extended position and a retracted position, said baskets being attached to said second portions of said supports.

8. The retractable shelving device as in claim 7, further including a lifting means for lifting said second portion toward said bar and into said retracted position.

9. The retractable shelving device as in claim 8, wherein said lifting mean includes a casing having a chamber therein, said casing being attached to each of said second portions, an axle extending through said casing and through said chamber, said axle being threaded and being threadably coupled to said casing, a spool being positioned in said casing, said axle extending through said spool such that said spool is rotatable with respect to said axle, a cord being attached to and being wound about said spool when said second portion is in said retracted position, said cord having an end attached to said bar, a biasing means biases rotation of said spool in a first direction.

10. The retractable shelving device as in claim 5, further including a lifting means for lifting said second portion toward said bar and into said retracted position.

11. The retractable shelving device as in claim 10, wherein said lifting mean includes a casing having a chamber therein, said casing being attached to each of said second portions, an axle extending through said casing and through said chamber, said axle being threaded and being threadably coupled to said casing, a spool being positioned in said casing, said axle extending through said spool such that said spool is rotatable with respect to said axle, a cord being attached to and being wound about said spool when said second portion is in said retracted position, said cord having an end attached to said bar, a biasing means biases rotation of said spool in a first direction.

12. A retractable shelving device comprising:

a housing having a back wall, a first lateral side wall, a second lateral side wall, a bottom wall and a top wall, a front side of said housing having an opening therein defined by a front edge of said top, bottom and lateral side walls;

a pair of railings each being positioned in said housing and being attached to said top wall, each of said railings extending from said back wall to said front edge of said top wall, said railings being spaced from each other, each of said railing comprising;

an elongated member having a first end and a second end, said elongated member having a middle portion and a pair of legs such that a cross-section taken traverse to a longitudinal axis of said elongated member generally has an upside down U-shape, each of said legs having a free end having a flange thereon, said flanges extending toward each other such that a slot is defined between said flanges, each of said flanges having a plurality of wheels rotatably attached thereto and having a rotational axis orientated perpendicular to said longitudinal axis of said elongated member, each of said legs having a plurality wheels rotatably coupled thereto and having a rotational axis orientated perpendicular to said longitudinal axis of said elongate member;

a pair of shelving assemblies each being extendably positioned on one of said railings such that each of said shelving assemblies may be selectively positioned between a point inside of said housing and a point outside of said housing, each of said shelving assemblies comprising;

a plurality of baskets, each of said baskets having a bottom wall and a peripheral wall extending upwardly from said bottom wall;

a hanging assembly comprising a top portion and pair of supports extending down from said top portion, said supports being spaced from each other, each of said baskets being positioned between and being attached to each of said supports such that said baskets are vertically positioned with relation to each other, said top portion being extendably positioned on one of said railings, said top portion including a bar and a sleeve, said sleeve being positionable in said elongated member and being movable along said wheels, said bar being extendable in said sleeve, said sleeve has a pair of open ends and a bottom side having a channel therein extending between ends of said sleeve, said supports being attached to said bar and extending through said channel, each of said supports including a first portion and a second portion, each of said first portions being attached to said bar and defining walls, each of said first portions having elongated depressions therein extending between and through opposite ends of said first portions, said depressions facing each other, each of said second portions being positioned in said depressions and being extendable between an extended position and a retracted position, said baskets being attached to said second portions of said supports; and a lifting means for lifting said second portion toward said bar and into said retracted position, said lifting mean including a casing having a chamber therein, said casing being attached to each of said second portions, an axle extending through said casing and through said chamber, said axle being threaded and being threadably coupled to said casing, a spool being positioned in said casing, said axle extending through said spool such that said spool is rotatable with respect to said axle, a cord being attached to and being wound about said spool when said second portion is in said retracted position, said cord having an end attached to said bar, a biasing means biases rotation of said spool in a first direction, said biasing means comprises a spring positioned between and attached to said spool and said casing, said spring being wound about said axle, said axle having an end having a handle thereon and positioned outside of said casing, said axle having a panel attached thereto and positioned in said chamber, wherein said panel may be abutted against said spool for selectively preventing rotation of said spool.

* * * * *